US012595097B2

(12) United States Patent
Farsht et al.

(10) Patent No.: US 12,595,097 B2
(45) Date of Patent: Apr. 7, 2026

(54) CAP DISPENSER ASSEMBLY

(71) Applicant: Tiny Brands, Inc., Chicago, IL (US)

(72) Inventors: Stephanie Farsht, Chicago, IL (US); Paul Earle, Winnetka, IL (US); Katja Lerner, Neenah, WI (US); Gary Paulsen, Chicago, IL (US); Jillian Tackaberry, Chicago, IL (US); Scott Wilson, Chicago, IL (US); Chris Watson, Highland Park, IL (US)

(73) Assignee: Tiny Brands, Inc., Chicago, IL (US)

( * ) Notice: Subject to any disclaimer, the term of this patent is extended or adjusted under 35 U.S.C. 154(b) by 236 days.

(21) Appl. No.: 18/388,453

(22) Filed: Nov. 9, 2023

(65) Prior Publication Data

US 2025/0011052 A1 Jan. 9, 2025

Related U.S. Application Data

(60) Provisional application No. 63/525,481, filed on Jul. 7, 2023.

(51) Int. Cl.
*B65D 47/06* (2006.01)

(52) U.S. Cl.
CPC ..... *B65D 47/06* (2013.01)

(58) Field of Classification Search
CPC ..... B65D 47/248
USPC ..... 222/185.1, 184, 518, 514, 525, 523
See application file for complete search history.

(56) References Cited

U.S. PATENT DOCUMENTS 48,341 A * 6/1865 Kloenne ..... B65D 47/248 215/315
600,901 A * 3/1898 Voelker ..... B65D 47/061 222/514
707,193 A * 8/1902 Allison ..... B65D 47/061 222/514
1,423,393 A * 7/1922 Boston ..... B65D 47/248 215/311
1,472,695 A * 10/1923 Stapley ..... A47K 5/1214 222/514
1,988,865 A * 1/1935 Campbell ..... G01F 11/34 222/525
2,067,523 A * 1/1937 Finney ..... B65D 47/248 222/453
2,176,988 A * 10/1939 Cameron ..... A47F 1/03 248/152

(Continued)

FOREIGN PATENT DOCUMENTS

EM 015088742 S 2/2025
WO WO-2007027709 A1 * 3/2007 ..... B65D 47/06

OTHER PUBLICATIONS

Jan. 21, 2025—(EM) Exam Report—App 015088742.

(Continued)

*Primary Examiner* — Frederick C Nicolas
*Assistant Examiner* — Michael J. Melaragno
(74) *Attorney, Agent, or Firm* — Banner & Witcoff, Ltd.

(57) ABSTRACT

A cap dispenser assembly with an outer frame, an inner frame, a dispensing shaft, and an actuator. The actuator may be configured to regulate the flow of contents through the cap dispenser assembly while shielding the dispensing shaft or the contents from a wet or moist environment. The actuator may be configured to reciprocate along a dispensing shaft.

17 Claims, 8 Drawing Sheets

(56) References Cited

U.S. PATENT DOCUMENTS 2,337,276 A * 12/1943 Sanchis ..... B65D 47/248 141/308
2,504,276 A * 4/1950 Olsen ..... B65D 51/1644 222/514
2,593,634 A * 4/1952 Vosburg ..... F16L 29/00 222/545
2,811,285 A * 10/1957 Stasny ..... A47K 5/1207 222/108
3,074,444 A * 1/1963 Hawksford ..... B65D 47/248 222/518
3,871,558 A * 3/1975 Gournelle ..... G01F 11/021 239/350
3,986,539 A * 10/1976 Bjerga ..... B65D 47/248 251/339
4,230,239 A * 10/1980 Birrell ..... G01F 11/34 222/440
4,372,467 A * 2/1983 Pritchitt ..... G03G 15/104 222/518
4,717,051 A * 1/1988 Leclerc ..... B67D 3/02 222/545
4,842,152 A * 6/1989 Donegan ..... F02F 7/006 222/495
D309,710 S 8/1990 Groves
4,972,976 A * 11/1990 Romero ..... B67D 3/0029 141/330
5,154,212 A * 10/1992 Weber ..... A47K 5/13 222/518
5,551,601 A * 9/1996 Camm ..... B67D 7/0244 222/137
5,791,526 A * 8/1998 Landais ..... A47J 31/404 222/325
D418,417 S 1/2000 Hollinger
6,131,774 A * 10/2000 Thomas ..... G01F 11/34 222/440
6,206,058 B1 * 3/2001 Nagel ..... B67D 3/0032 141/346
6,705,492 B2 * 3/2004 Lowry ..... A47K 5/122 222/215
6,923,345 B1 * 8/2005 Laible ..... B67D 7/0294 222/189.09
6,945,432 B2 * 9/2005 Laible ..... B67D 7/0294 222/518
6,945,433 B2 * 9/2005 Laible ..... B67D 7/0294 222/481.5
D593,874 S 6/2009 Nichols
D630,944 S 1/2011 Kawamura
8,087,547 B1 * 1/2012 Lindsey ..... B65D 35/56 222/173
D663,172 S 7/2012 Huynh
D763,685 S 8/2016 Arriaga
D812,980 S 3/2018 Buzzard et al.
D817,062 S 5/2018 Buzzard et al.
11,203,468 B2 * 12/2021 Ono ..... B65D 47/2068
11,286,149 B2 * 3/2022 Worthington ..... B67D 7/0288
D956,557 S 7/2022 Dan et al.
D981,246 S 3/2023 Waldo et al.
2001/0023877 A1 * 9/2001 Walters ..... B65D 83/46 222/173
2004/0000566 A1 * 1/2004 Lowry ..... B65D 51/249 222/184
2009/0200342 A1 * 8/2009 Albaum ..... B65D 47/0885 222/162
2010/0213215 A1 * 8/2010 Laible ..... B67D 7/36 222/518
2013/0105519 A1 * 5/2013 Sundberg ..... A47K 5/1207 222/190
2025/0011052 A1 * 1/2025 Farsht ..... B65D 47/06

OTHER PUBLICATIONS

Feb. 1, 2024 (WO) International Search Report and Written Opinion—App PCT/US2023/079169.
Jul. 29, 2025—(CN) First Office Action—App 202530015695X.

* cited by examiner

CAP DISPENSER ASSEMBLY

CROSS REFERENCE TO RELATED APPLICATION

Application claims priority to U.S. Provisional Patent Application No. 63/525,481, filed on Jul. 7, 2023.

FIELD

Aspects described herein generally relate to a cap dispenser assembly. More specifically, one or more aspects described herein provide for a cap dispenser assembly having an actuator configured to regulate the flow of contents through the cap dispenser assembly.

BACKGROUND

Certain granular compositions, such as salon concentrate, powdered shampoo, and the like, may be dispensed from a bottle through a cap assembly into a user's hand. Bottles and/or caps currently known in the field expose the contents of the bottle to moisture, which may impede the flow of the contents from the bottle or may impact the quality of the composition through such exposure. For example, bottles and/or caps current known in the field have their opening at the top of the bottle, exposing contents to moisture. Known bottles and/or caps often cause a user's hand to come in contact with the bottle opening, exposing the contents to moisture or dirt and/debris.

SUMMARY

The following presents a simplified summary of the disclosure in order to provide a basic understanding of some aspects of the disclosure. This summary is not an extensive overview of the disclosure. It is not intended to identify key or critical elements of the invention or to delineate the scope of the invention. The following summary merely presents some concepts of the disclosure in a simplified form as a prelude to the more detailed description provided below.

As described in more detail herein, this application sets forth a cap dispenser assembly comprising an inner frame (or a first frame), an outer frame (or a second frame), and an actuator. The actuator may be configured to regulate the flow of contents through the cap dispenser assembly while shielding the contents of a dispenser bottle from a moist or wet environment while not in use. The actuator may be configured to reciprocate along a dispensing shaft from a first position to a second position. The actuator may be configured to move with the inner frame relative to the outer frame providing an opening to allow contents to be dispersed from the assembly.

An example cap dispenser assembly may comprise an outer frame, a dispensing shaft comprising a first surface, an inner frame comprising a first end and a second end, and an actuator disposed between the outer frame and the inner frame and configured to reciprocate along the dispensing shaft from a first position to a second position. The first end of the inner frame may be configured to extend past the first surface of the dispensing shaft when the actuator is in the second position. In the first position the actuator may contact a first edge of the dispensing shaft. In the second position the actuator may expose at least a portion of the dispensing shaft. The inner frame may be coupled to the actuator. A force applied to the inner frame may cause the actuator to reciprocate from the first position to at least one of the plurality of intermediate positions or the second position.

Another example cap dispenser may comprise an outer frame, a dispensing shaft comprising a first surface, an inner frame comprising a first end, and an actuator disposed between the outer frame and the inner frame and configured to reciprocate along the dispensing shaft from a first position to a second position. The first end of the inner frame may be configured to extend past the first surface of the dispensing shaft when the actuator is in the second position.

These as well as other novel advantages, details, examples, features and objects of the present disclosure will be apparent to those skilled in the art from following the detailed description, the attached claims and accompanying drawings, listed herein, which are useful in explaining the concepts discussed herein.

BRIEF DESCRIPTION OF THE DRAWINGS

Some features are shown by way of example, and not by limitation, in the accompanying drawings. In the drawings, like numerals reference similar elements.

DETAILED DESCRIPTION

In the following description of the various examples, reference is made to the accompanying drawings, which form a part hereof, and in which is shown by way of illustration various examples in which aspects may be practiced. References to "embodiment," "example," and the like indicate that the embodiment(s) or example(s) of the invention so described may include particular features, structures, or characteristics, but not every embodiment or example necessarily includes the particular features, structures, or characteristics. Further, it is contemplated that certain embodiments or examples may have some, all, or none of the features described for other examples. And it is to be understood that other embodiments and examples may be utilized and structural and functional modifications may be made without departing from the scope of the present disclosure.

Unless otherwise specified, the use of the serial adjectives, such as, "first," "second," "third," and the like that are used to describe components, are used only to indicate different components, which can be similar components. But the use of such serial adjectives is not intended to imply that the components must be provided in given order, either temporally, spatially, in ranking, or in any other way.

Also, while the terms "front." "back." "side," and the like may be used in this specification to describe various example features and elements, these terms are used herein as a matter of convenience, for example, based on the example orientations shown in the figures and/or the orientations in typical use. Nothing in this specification should be construed as requiring a specific three dimensional or spatial orientation of structures in order to fall within the scope of the claims.

Figure 1:
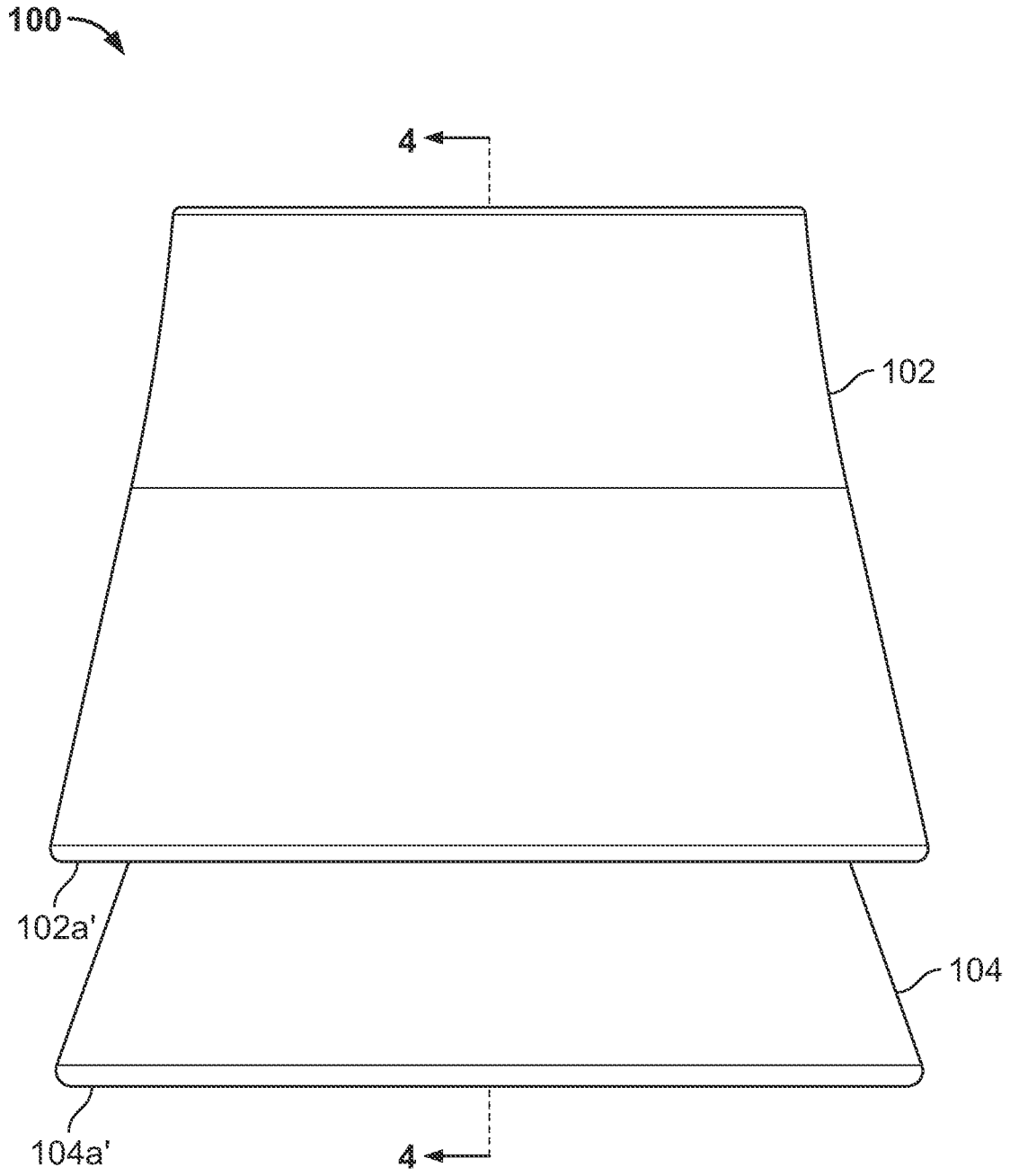
FIG. 1 illustrates a front view of an example cap dispenser assembly that may be used to implement one or more illustrative aspects described herein.

FIG. 1 illustrates a side view of an example cap dispenser assembly 100 (hereinafter referred to as "cap assembly") that may be used to implement one or more illustrative aspects described herein. Cap assembly 100 may include outer frame 102 and inner frame 104. Outer frame 102 and inner frame 104 may be constructed from a wide variety of resilient materials, such as any number of thermoplastic polymers, cellulose acetate, etc. Outer frame 102 and inner frame 104 may be constructed according to a variety of geometries (i.e., substantially conical, substantially spherical, substantially cylindrical, etc.). In an example, outer frame 102 and/or inner frame 104 may be constructed with a substantially cylindrical geometry. Outer frame 102 may be outwardly flared towards end 102*a*'. Inner frame 104 may be outwardly flared towards end 104*a*'. Outer frame 102 and inner frame 104 may be substantially hollow. Inner frame 104 may have a maximum outside diameter (or maximum width, as the case may be) that may be less than, equal to, or greater than that of outer frame 102. Inner frame 104 may partially nest inside of outer frame 102. End 104*a*' of inner frame 104 may extend past end 102*a*' of outer frame 102. Outer frame 102 and inner frame 104 may be coupled or joined by an actuator (discussed in greater detail with respect to FIGS. 2*c*, 3, and 4). Outer frame 102 and inner frame 104 may be vertically aligned with one another. That is, when outer frame 102 and inner frame 104 are nested, they may each have a center point that may be defined by the same vertical axis.

Cap assembly 100 may be configured such that inner frame 104 is able to be actuated towards outer frame 102. Actuation of inner frame 104 towards outer frame 102 may expose an opening in a dispensing shaft (discussed in greater detail with respect to FIG. 4) such that the contents of, for example, a bottle removably coupled to cap assembly 100 may travel through the opening in the dispensing shaft and into a user's hands. Cap assembly 100 may be configured to help restrict the flow of the bottle's contents while in a non-actuated state or position. Cap assembly 100 may be configured to allow for a flow of content while in an actuated state or position. Cap assembly 100 may be configured to actuate from a first position (i.e., a fully closed position) to a second position (i.e., a fully open position) through any number of intermediate positions (i.e., 10%, 20%, 30%, 40%, 50%, 75%, or 90% open positions, etc.) which may help regulate the flow of a variety of compositions of content.

Figure 2A:
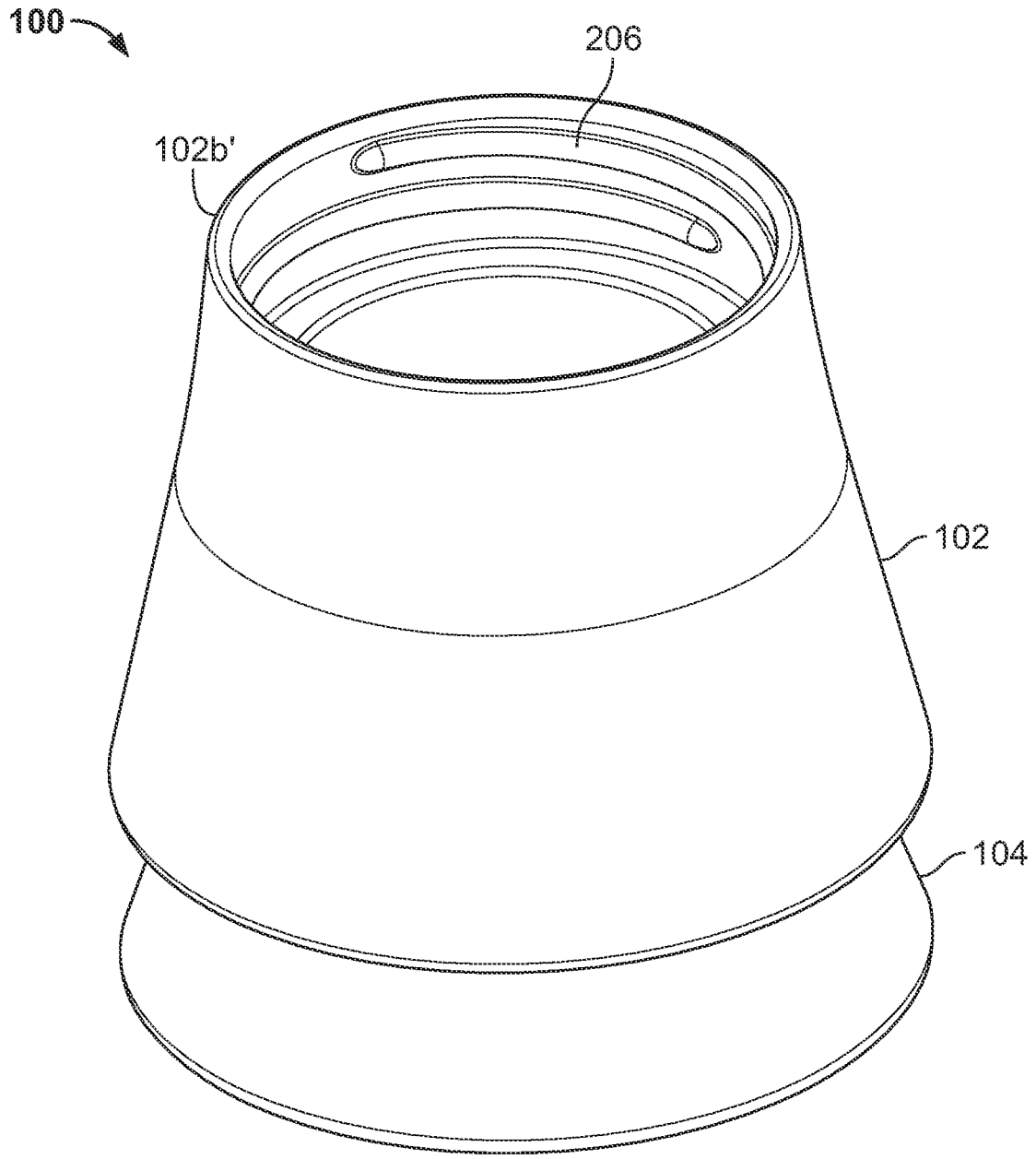
FIG. 2*a* illustrates a perspective view of the example cap dispenser assembly of FIG. 1.
Figure 6A:
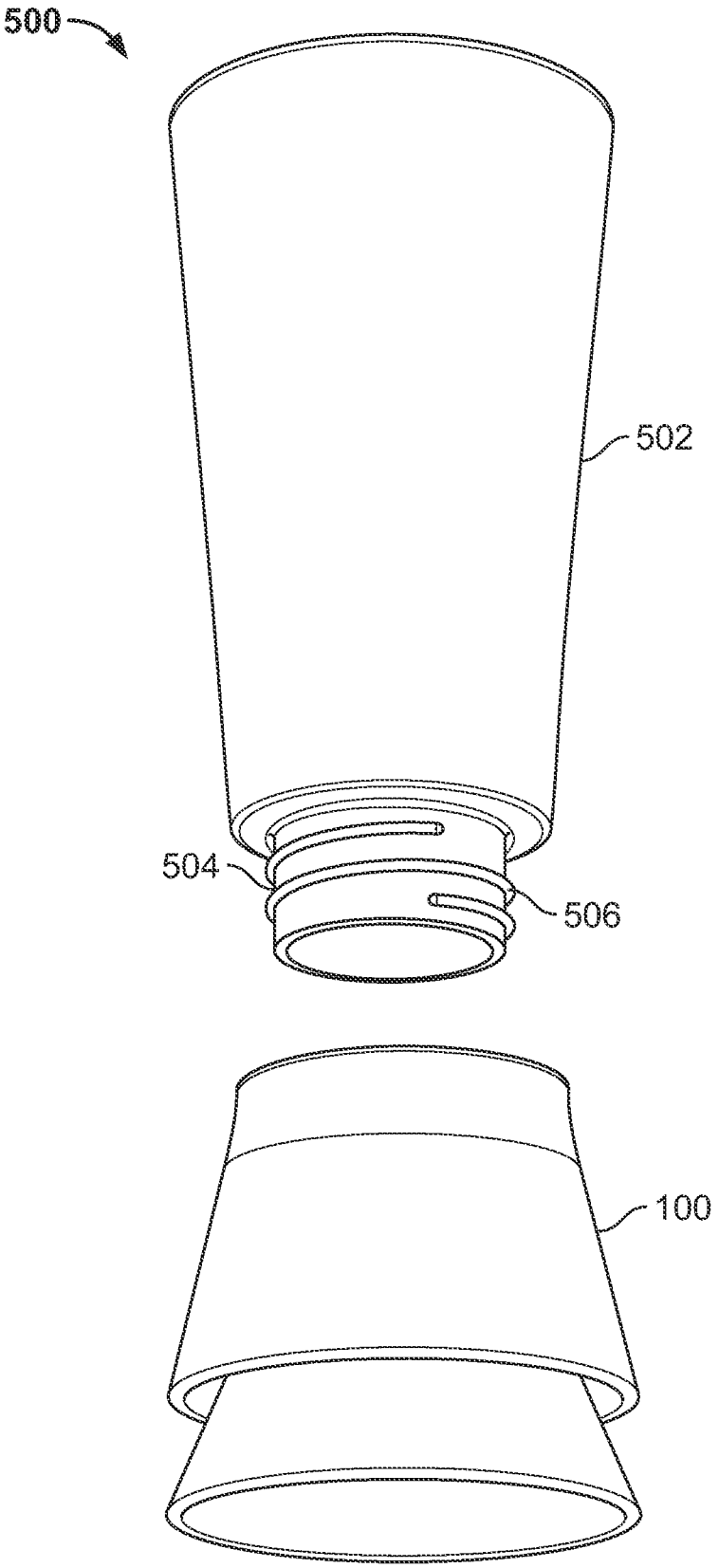
FIG. 6*a* illustrates an exploded perspective view of an example cap dispenser assembly that may be used to implement one or more illustrative aspects described herein and a bottle.
Figure 6B:
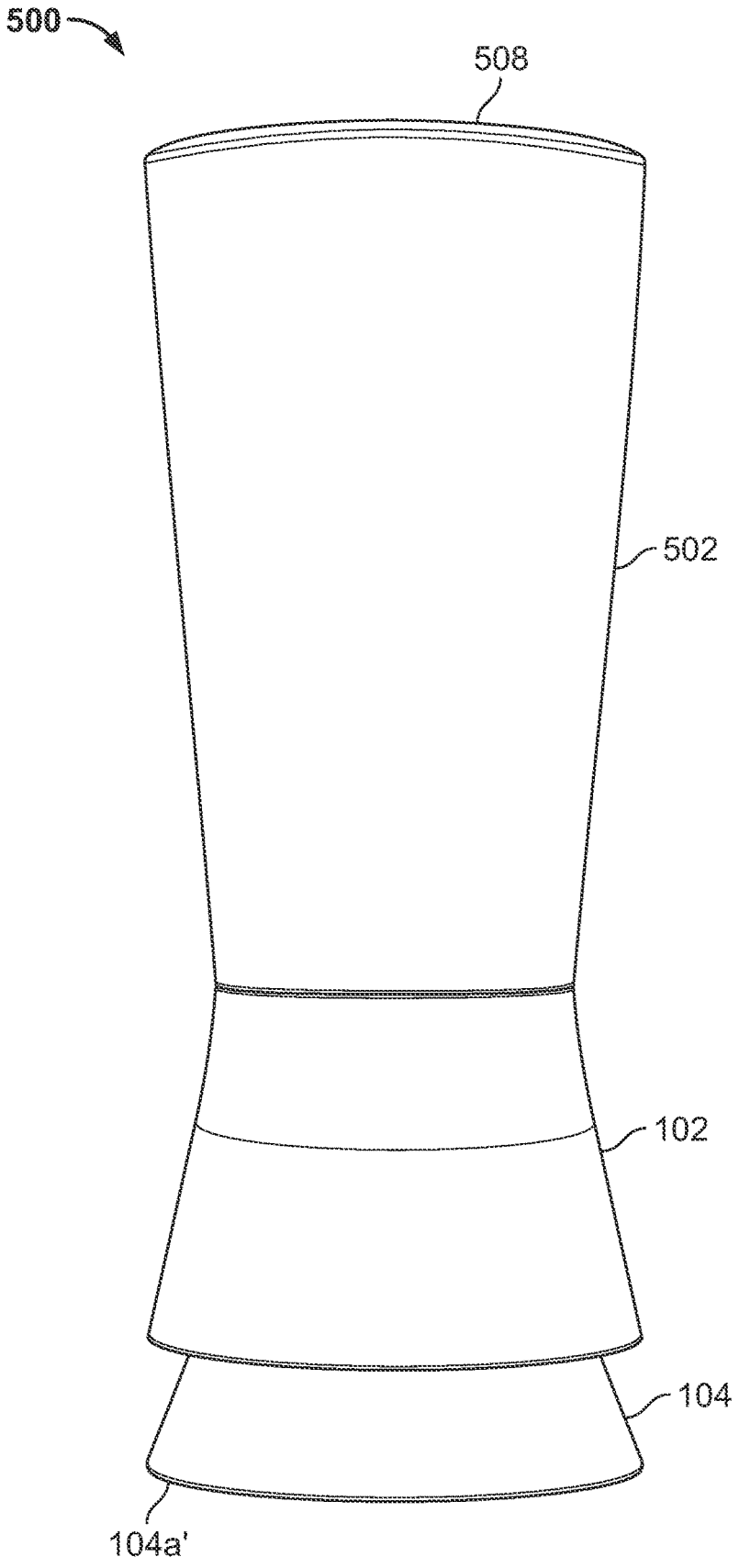
FIG. 6*b* illustrates a front view of the example cap dispenser assembly that may be used to implement one or more illustrative aspects described herein and the bottle of FIG. 6*a*.

As shown in FIG. 2*a*, outer frame 102 may be configured to removably couple to another implement, such as, for example, a bottle (shown and discussed in greater detail with respect to FIGS. 6*a* and 6*b*). In an example, end 102*b*' may include an internal threaded portion (or threads) 206. Threads 206 may be configured to engage with complementary threads from another implement, such as, for example, a bottle. End 102*b*' may include a wide variety of coupling mechanisms and is not limited to threads. For example, end 102*b*' may include a locking mechanism configured to interface with a corresponding push-tab on a bottle.

Figure 2B:
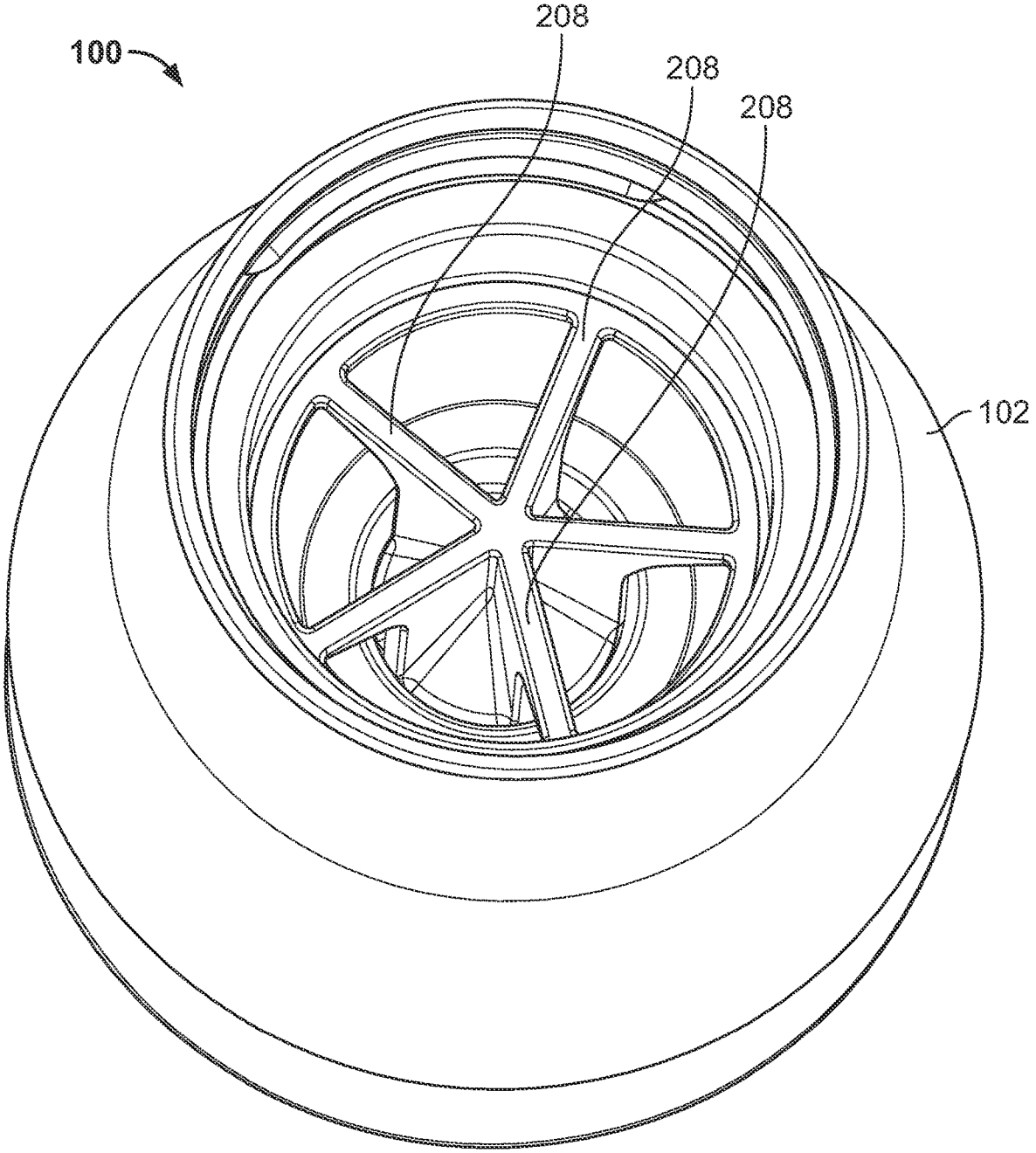
FIG. 2*b* illustrates a top-down perspective view of the example cap dispenser assembly of FIG. 1.

FIG. 2*b* illustrates a top down perspective view of cap assembly 100. As previously discussed, outer frame 102 may be substantially hollow. Outer frame 102 may define a channel through which contents of a bottle may travel. Outer frame 102 may include a plurality of support ribs 208 that may be integrally molded to outer frame 102. Support ribs 208 may be radially oriented about the center, or midpoint, of outer frame 102. Support ribs 208 may generally extend outwardly from the midpoint of outer frame 102. While there are five (5) support ribs 208 shown in FIG. 2*b*, it is contemplated that outer frame 102 may include more than five or fewer than five support ribs. Support ribs 208 may extend toward end 102*a*' of outer frame 102 and may gradually taper into shaft 404 and/or fins 403 (discussed with respect to FIG. 4). Support ribs 208 may help prevent collapse of the actuator when a user actuates the cap assembly 100.

Figure 3:
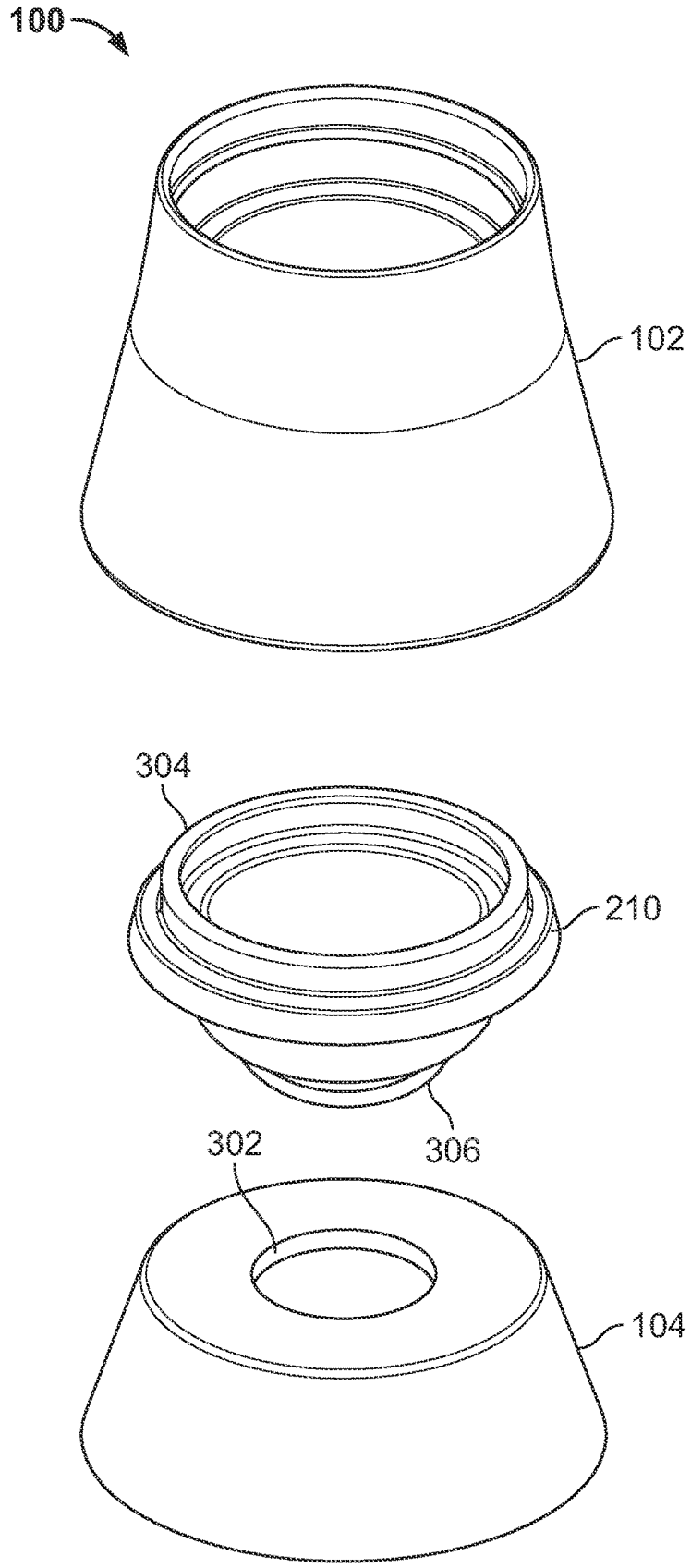
FIG. 3 illustrates an exploded perspective view of an example cap dispenser assembly that may be used to implement one or more illustrative aspects described herein.

FIG. 3 illustrates an exploded view of cap assembly 100. As discussed above, cap assembly 100 may include outer frame 102, inner frame 104, and actuator 210. Actuator 210 may be constructed from a variety of flexibly resilient materials such as a polymer including, but not limited to, silicone, or rubber. In other words, actuator 210 may deform when subjected to sufficient force and may return to its original shape when the force ceases to be applied. In another example, actuator 210 may be constructed from a rigid material. Actuator may be constructed according to a number of geometries without departing from the scope of this disclosure. In other words, actuator 210 may be geometrically shaped to interface with outer frame 102 and inner frame 104, which themselves may be constructed according to a number of geometries. Actuator 210 may include a spring. Actuator 210 may be constructed primarily from a spring. Actuator 210 may be formed from any number of mechanical structures that are capable of axially reciprocating along shaft 404 (that is, reciprocating about the vertical axis defined by shaft 404).

Outer frame 102 and/or inner frame 104 may be coupled to actuator 210. Actuator 210 may include top appendage 304 which may be configured to couple to outer frame 102. In an example, top appendage 304 may be configured as a ring-line structure or a gasket-like structure. Top appendage 304 may couple with a corresponding channel of outer frame 104 and may securely couple outer frame 102 to actuator 210 (shown in greater detail with respect to FIG. 4). Actuator 210 may include bottom appendage 306 which may be configured to couple to inner frame 104. Bottom appendage 306 may be configured as a gasket-like structure. Inner frame 104 may include an opening 302 configured to receive bottom appendage 306. Bottom appendage 306 may include a channel which may interface with the walls of opening 302 of inner frame 104 and may securely couple inner frame 104 to actuator 210 (shown in greater detail with respect to FIG. 4). Actuator 210 may be co-molded to outer frame 102 and/or inner frame 104.

Figure 4:
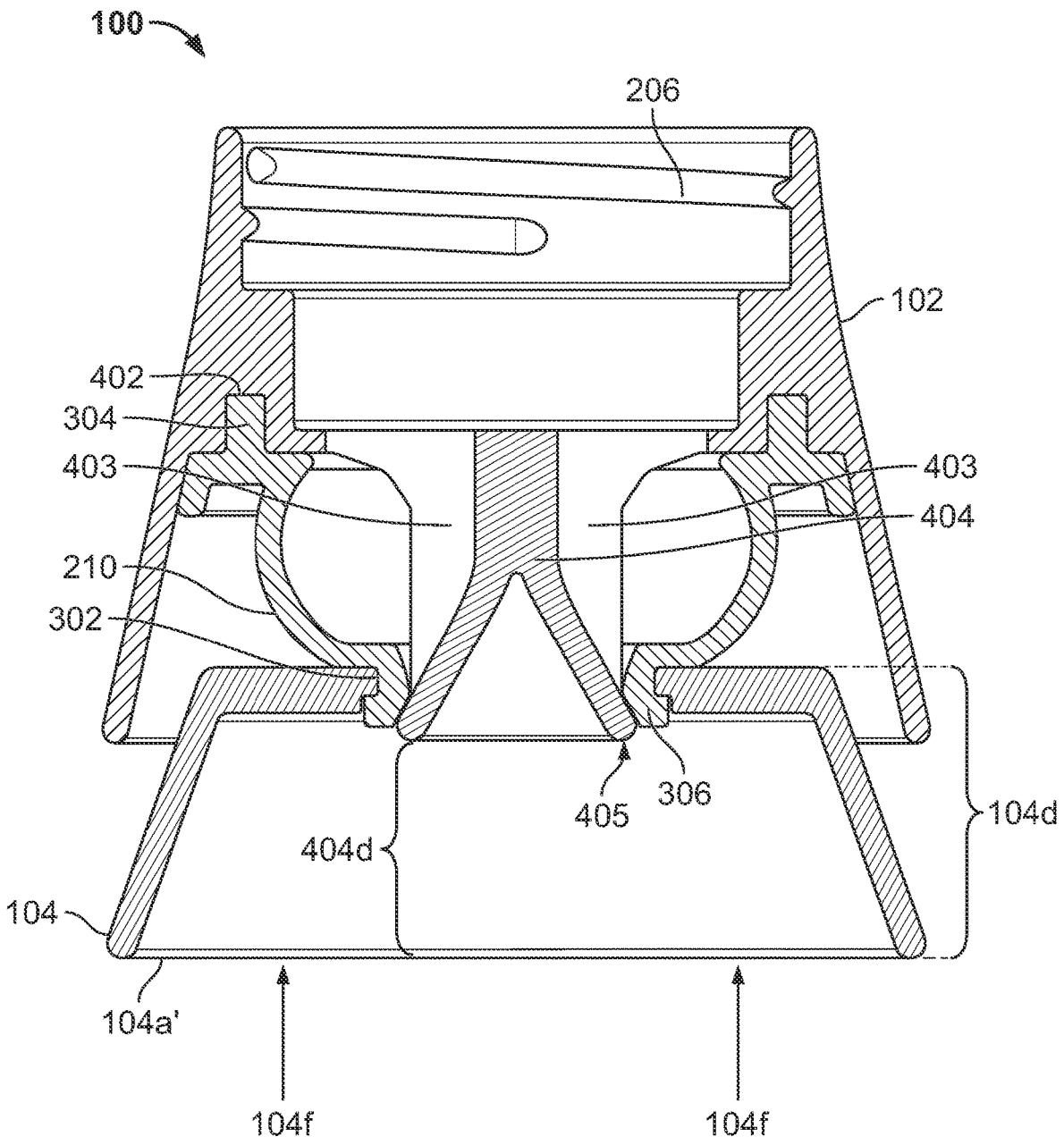
FIG. 4 illustrates a cross-section view of an example cap dispenser assembly as indicated by the line "FIG. 4" in FIG. 1.

As shown in FIG. 4, which illustrates a vertical cross-section of cap assembly 100, actuator 210 may be removably coupled to outer frame 102 and removably coupled to inner frame 104. Actuator 210 may be integrally formed with outer frame 102 and/or inner frame 104. Channel 402 may receive top appendage 304 which may removably couple outer frame 102 to actuator 210. In an example channel 402 may receive top appendage 304 to securely couple outer frame 102 to actuator 210. Bottom appendage 306 may include a channel which may interface with the walls of opening 302 and may removably couple inner frame 104 to actuator 210. In other examples bottom appendage 306 may include a channel which may interface with the walls of opening 302 and may securely couple inner frame 104 to actuator 210.

Outer frame 102 may include central dispensing shaft member 404 (hereinafter referred to as "shaft 404" or "dispensing shaft"). Shaft 404 may be integrally molded to outer frame 102 and/or support ribs 208. Shaft 404 may be constructed according to a number of geometries. In an example, shaft 404 may be substantially cylindrical. Shaft 404 may gradually widen toward surface 405. Shaft 404 may include a plurality of fins 403 that may be integrally molded to shaft 404 or ribs 208. Fins 403 may extend from support ribs 208 through substantially the entirety of the length of shaft 404 to surface 405. Fins 403 may be configured similarly as support ribs 208 in that they may be radially oriented about the center, or midpoint, of outer frame 102. Fins 403 may be configured with a gradually decreasing width (as measured from the center, or midpoint, of outer frame 102) from support ribs 208 through substantially the entirety of the length of shaft 404. Fins 403 may merge with surface 405 of shaft 404. Fins 403 may define openings, or troughs (not shown), that extend from support ribs 208 through substantially the entirety of the length of shaft 404. The number of troughs may correspond to the number of support ribs 208 and/or fins 403. The troughs may be configured to allow passage of contents from a bottle through an opening between shaft 404 and actuator 210 to, for example, a user's hand(s), based on a force being applied to actuator 210 as discussed herein.

In FIG. 4, actuator 210 is shown in the non-actuated state or position. In the non-actuated position, actuator 210 and surface 405 of shaft 404 may act as a seal to prevent the contents from a bottle exiting or leaking through shaft 404. Specifically, when actuator 210 is in the non-actuated position, bottom appendage 306 may engage with the sidewalls of shaft 404 near surface 405 of shaft 404 and may create a seal between shaft 404 and actuator 210. The seal between shaft 404 and actuator 210 may help prohibit the inadvertent leaking of contents through cap assembly 100 while the cap assembly 100 and bottle are not in use.

Actuator 210 may respond to a force 104*f* to inner frame 104. A sufficient force 104*f* may cause an upward vertical displacement of inner frame 104. As inner frame 104 becomes vertically displaced, actuator 210 becomes deformed and transitions into an actuated state or position. Consequently, the junction (or seal) of bottom appendage 306 and the sidewalls of shaft 404 near surface 405 begins to break and exposes an opening between shaft 404 and actuator 210, such as one or more of the troughs of shaft 404. As the inner frame is vertically displaced (i.e., towards end 102*b*' of outer frame 102) by force 104*f*, appendage 306 of actuator 210 may retain a diameter defined by shaft 404 and/or fins 403. The configuration of shaft 404 and/or fins 403 may help appendage 306 maintain a uniform diameter when translating from a first position (i.e., a closed, or non-actuated position) to a second position (i.e., an "open" or fully-actuated position) through any number of intermediate positions. Based on a user applying a sufficient force 104*f* to cause actuation of actuator 210, the contents of a bottle may be dispensed through cap assembly 100 into, for example, a user's hands. The flow of the contents may be aided by the force of gravity.

Cap assembly 100 may be configured to help prevent bottom surface 405 of shaft 404 and/or actuator 210 from contacting a wet or moist surface. The length of shaft 404 or the total height of inner frame 104, alone or in combination, may be configured to help prevent bottom surface 405 and/or actuator 210 from contacting the surface environment. The resiliency (i.e., resistance to deformity) and specific geometry of actuator 210 may restrict the upward vertical displacement of inner frame 104 to a predetermined distance relative to surface 405 of shaft 404. At full actuation, i.e., the maximum opening between shaft 404 and actuator 210, distance 404*d* between surface 405 and/or actuator 210 and end 104*a*' of inner frame 104 may be less than the total height 104*d* of inner frame 104. In other words, end 104*a*' of inner frame 104 may be the only point of contact with the surface environment. Surface 405 of shaft 404 and/or actuator 210 may therefore be appreciably elevated above the surface environment when actuator 210 is at partial or full actuation.

Figure 5:
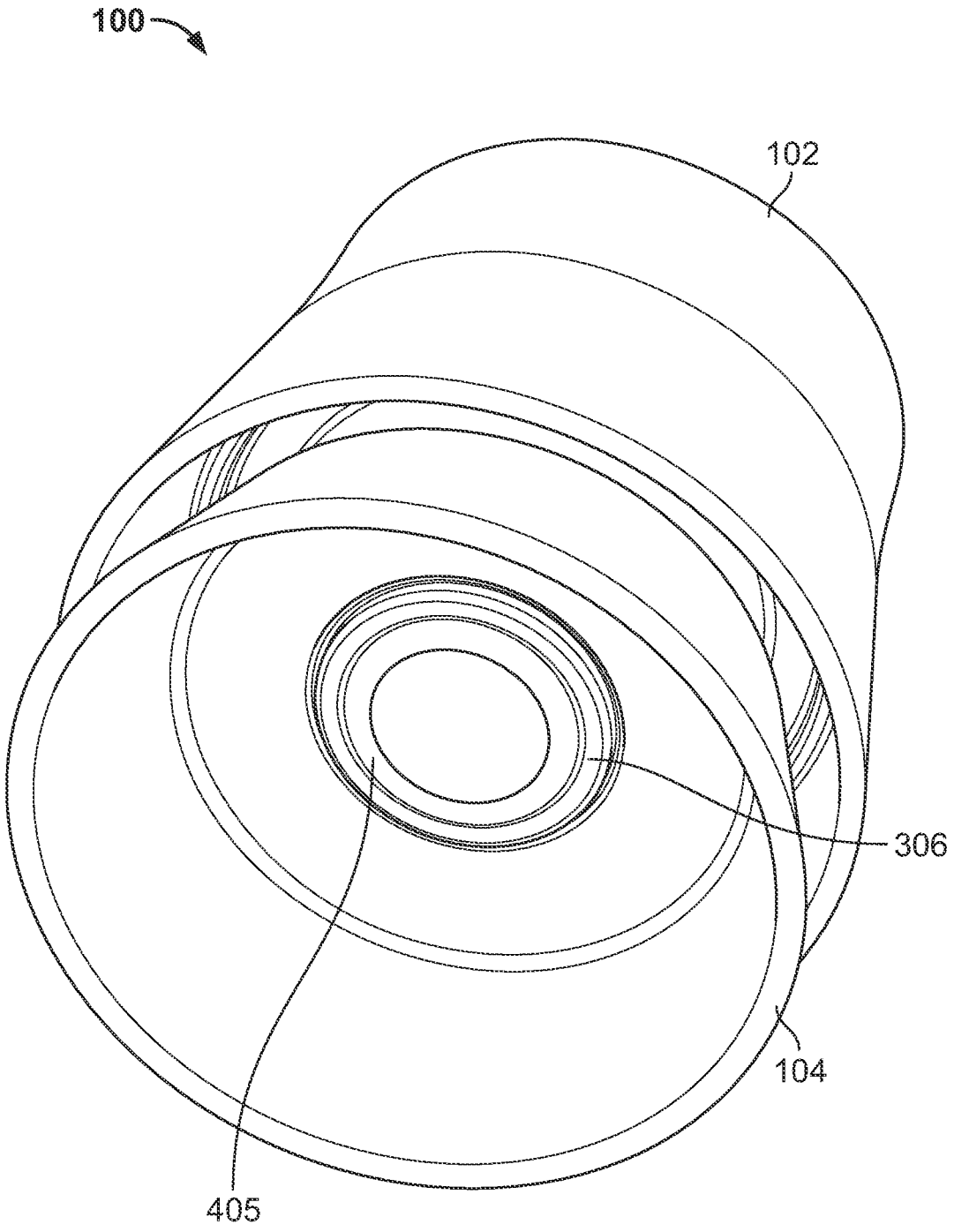
FIG. 5 illustrates a bottom-up perspective view of the example cap dispenser assembly of FIG. 1.

FIG. 5 illustrates a bottom-up perspective view of cap assembly 100. As discussed above, cap assembly 100 may include an outer frame member 102 and an inner frame member 104. Cap assembly 100 may include a shaft 404 configured to permit the flow of contents through cap assembly 100 when actuator 210 is activated. Shaft 404 may include a surface 405 that interfaces with actuator 210, and specifically appendage 306, to restrict the flow of contents when actuator 210 is in a non-actuated state. Inner frame 104 may shield actuator 210, surface 405, and/or shaft 404 from environmental factors such as moisture or humidity.

FIG. 6*a* illustrates an example cap dispenser and bottle assembly 500. Cap assembly 100 may be configured to removably couple to a bottle, such as bottle 502. Bottle 502 may be constructed according to a number of geometries (i.e., columnar, spherical, cylindrical, pyramidal, conical, etc.). Bottle 502 may be constructed from a number of materials, including, but not limited to, stainless steel, aluminum, plastic, or any other resilient material. Cap assembly 100 may be configured to removably couple to bottle 502 according to a number of mechanisms. In an example, bottle 502 may include a first end, or engaging end, 504. Engaging end 504 may include threads 506 that may correspond to and interface with threads 206 of bottle cap assembly 100. Cap assembly 100 may interface with engaging end 504 according to a number of mechanisms, including, but not limited to, a press-fit configuration. In an example, engaging end 504 may include a locking tab (not shown). Cap assembly 100 may include a corresponding cavity (not shown) through which the locking tab removably couples bottle 502 to cap assembly 100.

Cap and bottle assembly 500 may be configured to be used and stored in an orientation wherein inner frame 104 supports cap and bottle assembly 500 on a surface, such as a user's hands, a shower cabinet, a countertop, etc. As shown in FIG. 6*b*, a user may thread cap assembly 100 to bottle 500 such that cap assembly 100, specifically inner frame 104, may support cap and bottle assembly 500 while in storage or otherwise not in use. End 104*a*' may be configured to help prevent cap and bottle assembly 500 from tipping over. For example, end 104*a*' may be flared to increase the diameter (or width, as the case may be) of end 104*a*'. Bottle 502 may include a second end, or top end, 508. Top end 508 may be configured to allow cap and bottle assembly and/or simply bottle 502 to rest on a surface (i.e., a flat surface such as a countertop, shower cabinet, etc.). That is, a user may orient cap and bottle assembly such that top end 508 may contact the surface when the user refills the contents of bottle 502. Top end 508 may be configured such that if a user stores cap and bottle assembly 500 where top end 508 contacts the surface instead of inner frame 104, cap and bottle assembly 500 might not rest perpendicularly to the surface. For example, top end 508 may be arcuate. Top end 508 may be arcuately constructed to various degrees. That is, top end 508 may allow cap and bottle assembly 500 to rest in a non-perpendicular orientation to a surface without necessarily causing cap and bottle assembly 500 to topple over. This might not be aesthetically pleasing to a user or may expose shaft 404 and/or actuator 210 to a wet environment, which may impair the flow of contents through cap assembly 100. Accordingly, a configuration wherein top end 508 is arcuate may help to encourage a user to store cap and bottle assembly 500 in an orientation where inner frame 104 contacts a surface and supports cap and bottle assembly 500. Inner frame 104 may shield shaft 404 and actuator 210 from environmental factors such as humidity, moisture, and contact with liquids.

Actuator 210 may be configured to respond to a sufficient force to enable the flow of contents from bottle 502 through shaft 404 while exhibiting sufficient resiliency to prevent the unwanted flow of contents from bottle 502 when cap and bottle assembly 500 is being stored on a surface, such as, for example, a shower cabinet, a countertop, and the like. The resiliency (i.e., resistance to deformity or actuation) of actuator 210 (which may be in part due to the composition of actuator 210), the specific geometry of actuator 210, and/or the dimensions of actuator 210, such as thickness, may help enable cap assembly 100, and particularly inner frame 104, to support the weight of bottle 502 and its contents while being stored (i.e., not in use) without disturbing actuator 210 from a non-actuated position or state. Cap assembly 100 may include a locking mechanism (not shown) that may prohibit the movement of inner frame 104 relative to outer frame 102 to prevent inadvertent dispensation. In an example, the locking mechanism may be integral to inner frame 104 and/or outer frame 102. In an example, the locking mechanism may couple to outer frame 104 and may seal end 104*a*'. The locking mechanism may contact end 102*a*' and may prevent activation of actuator 210 by restricting movement of inner frame 104 relative to outer frame 102. In other examples, the locking mechanism may include a cap or end piece that couples to inner frame and prevents content from exiting the cap assembly.

A cap assembly may comprise an inner frame, a dispensing shaft, and an actuator coupled to the inner frame and disposed above the inner frame. The actuator may be configured to reciprocate along the dispensing shaft from a first position to a second position. In the first position the actuator may form a seal with a first edge of the dispensing shaft. In the second position the actuator may provide an opening between the inner frame and the dispensing shaft. The dispensing shaft may comprise a plurality of support arms which may extend outwardly from a midpoint of the dispensing shaft and may be disposed above the actuator. The dispensing shaft may comprise a trough formed by a first support arm and a second support arm. The first support arm and the second support arm may be integrally formed with the dispensing shaft and may extend outwardly from a midpoint of the dispensing shaft. The dispenser cap may further comprise an outer frame coupled to the actuator, wherein the actuator may be disposed between the inner frame and the outer frame, and wherein the outer frame may comprise a threaded end. The inner frame may be nested inside the outer frame. The actuator may comprise silicone. The cap assembly may comprise a bottle configured to removably couple to the outer frame. The bottle may comprise a first engaging end and a second arcuate end. The actuator may comprise a spring.

A cap assembly may comprise an outer frame, a dispensing shaft comprising a first surface, an inner frame comprising a first end, and an actuator disposed between the outer frame and the inner frame and configured to reciprocate along the dispensing shaft from a first position to a second position. The first end of the inner frame may be configured to extend past the first surface of the dispensing shaft when the actuator is in the second position. In the first position the actuator may form a seal with an edge of the dispensing shaft. In the second position the actuator may provide an opening between the actuator and the dispensing shaft. The inner frame may be coupled to the actuator. A force applied to the inner frame may cause the actuator to travel from the first position to at least one of the plurality of intermediate positions or the second position. The outer frame may be coupled to the actuator. The dispensing shaft may comprise a plurality of support arms which may extend outwardly from a midpoint of the dispensing shaft and may be disposed above the actuator. The dispensing shaft may comprise a trough formed by a first support arm and a second support arm, wherein the first support arm and the second support arm may extend outwardly from a midpoint of the dispensing shaft. The outer frame may comprise a threaded end. The actuator may comprise silicone. The dispenser cap may further comprise a bottle configured to couple to the outer frame. The bottle may comprise a first engaging end and a second arcuate end.

In the foregoing specification, the present disclosure has been described with reference to specific exemplary examples thereof. Although the invention has been described in terms of a preferred example, those skilled in the art will recognize that various modifications, examples or variations of the invention can be practiced within the spirit and scope of the invention as set forth in the appended claims. The specification and drawings are, therefore, to be regarded in an illustrated rather than restrictive sense. Accordingly, it is not intended that the invention be limited except as may be necessary in view of the appended claims.

The invention claimed is:

1. A cap dispenser assembly comprising:

an outer frame;

an inner frame comprising a first end;

a dispensing shaft comprising a first surface and a plurality of support ribs that extend outwardly from a midpoint of the dispensing shaft and that are disposed above an actuator; and, the actuator, wherein the actuator is disposed between the outer frame and the inner frame and configured to reciprocate along the dispensing shaft from a first position to a second position; and wherein the first end of the inner frame is configured to extend past the first surface of the dispensing shaft when the actuator is in the second position.

2. The cap dispenser assembly of claim 1, wherein in the first position the actuator forms a seal with a first edge of the dispensing shaft.

3. The cap dispenser assembly of claim 1, wherein there is an opening between the actuator and the dispensing shaft when the actuator in the second position.

4. The cap dispenser assembly of claim 1, wherein the inner frame is coupled to the actuator, and wherein a force applied to the inner frame causes the actuator to travel from the first position to at least one of a plurality of intermediate positions or the second position.

5. The cap dispenser assembly of claim 1, wherein the outer frame is coupled to the actuator.

6. The cap dispenser assembly of claim 1 wherein the outer frame comprises a threaded end.

7. The cap dispenser assembly of claim 1, wherein the actuator comprises silicone.

8. The cap dispenser assembly of claim 1, further comprising a bottle configured to couple to the outer frame, wherein the bottle comprises a first engaging end and a second arcuate end.

9. A cap dispenser assembly comprising:

a first frame;

an actuator coupled to the first frame and disposed above the first frame; and, a dispensing shaft compromising a plurality of support ribs that extend outwardly from a midpoint of the dispensing shaft and that are disposed above the actuator; and wherein the actuator is configured to reciprocate along the dispensing shaft from a first position to a second position.

10. The cap dispenser assembly of claim 9, wherein in the first position the actuator forms a seal with a first edge of the dispensing shaft and wherein in the second position there is an opening between the actuator and the dispensing shaft.

11. The cap dispenser assembly of claim 9, further comprising a second frame coupled to the actuator, wherein the actuator is disposed between the first frame and the second frame, and wherein the second frame comprises a threaded end.

12. The cap dispenser assembly of claim 11, wherein the first frame is nested inside the second frame.

13. The cap dispenser assembly of claim 11, further comprising a bottle configured to removably couple to the second frame, wherein the bottle comprises a first engaging end and a second arcuate end.

14. A cap dispenser assembly comprising:

an outer frame;

an inner frame comprising a first end;

a dispensing shaft comprising a first surface and a plurality of support ribs that extend outwardly from a midpoint of the dispensing shaft and that are disposed above an actuator; and the actuator, wherein the actuator is disposed between the outer frame and the inner frame and configured to reciprocate along the dispensing shaft from a first position to a second position; and wherein in the first position the actuator forms a seal with a first edge of the dispensing shaft and wherein in the second position there is an opening between the actuator and the dispensing shaft.

15. The cap dispenser assembly of claim 14, wherein the first end of the inner frame is configured to extend past the first surface of the dispensing shaft when the actuator is in the second position.

16. The cap dispenser assembly of claim 14, wherein the outer frame is coupled to the actuator.

17. The cap dispenser assembly cap of claim 14, further comprising a bottle configured to couple to the outer frame, wherein the bottle comprises a first engaging end and a second arcuate end.

* * * * *